US009482051B1

(12) United States Patent
Green

(10) Patent No.: US 9,482,051 B1
(45) Date of Patent: Nov. 1, 2016

(54) SCREEN DOOR

(71) Applicant: MARHAYGUE, LLC, Pawleys Island, SC (US)

(72) Inventor: Guerry E Green, Pawleys Island, SC (US)

(73) Assignee: Marhaygue, LLC, Pawleys Island, SC (US)

( * ) Notice: Subject to any disclaimer, the term of this patent is extended or adjusted under 35 U.S.C. 154(b) by 0 days.

(21) Appl. No.: 14/681,754

(22) Filed: Apr. 8, 2015

(51) Int. Cl.

| | |
|---|---|
| ***E05D 13/00*** | (2006.01) |
| ***E06B 9/52*** | (2006.01) |
| ***E06B 5/00*** | (2006.01) |
| ***E06B 7/02*** | (2006.01) |

(52) U.S. Cl.
CPC . *E06B 9/52* (2013.01); *E06B 5/00* (2013.01); *E06B 7/02* (2013.01); *E06B 2009/527* (2013.01)

(58) Field of Classification Search
CPC ..... E06B 9/52; E06B 5/00; E06B 7/02; E06B 2009/527; B29C 2073/264; B29C 66/0224; B29C 66/02245; B29C 66/02241; B29C 66/0246
See application file for complete search history.

(56) References Cited

U.S. PATENT DOCUMENTS 2,049,831 A * 8/1936 Cruickshank ..... E06B 9/52 160/376
3,647,590 A * 3/1972 Wolf ..... B29C 53/066 156/211
4,084,360 A * 4/1978 Reckson ..... E06B 9/52 160/371
5,039,246 A * 8/1991 Woodruff ..... E06B 9/521 160/392
5,666,773 A * 9/1997 Librande ..... B29C 66/72523 160/369
6,250,040 B1 6/2001 Green
6,401,428 B1 * 6/2002 Glover ..... E06B 3/24 52/786.1
6,668,495 B1 * 12/2003 Prince ..... E04C 3/06 160/391
6,766,621 B2 7/2004 Reppermund
6,807,785 B2 10/2004 Lynch et al.
7,195,053 B2 3/2007 Pylkki et al.
7,201,208 B2 4/2007 Pylkki et al.
7,222,467 B2 5/2007 Nowell et al.
7,588,653 B2 * 9/2009 Crandell ..... E06B 3/24 156/109
7,658,046 B2 2/2010 Lynch et al.
7,661,227 B2 2/2010 Dudley et al.
7,669,380 B2 3/2010 Logan et al.
7,753,101 B2 7/2010 Johnson
8,042,598 B2 10/2011 Bredemus et al.
8,627,630 B2 1/2014 Oberbroeckling (Continued)

*Primary Examiner* — Katherine Mitchell
*Assistant Examiner* — Abe Massad
(74) *Attorney, Agent, or Firm* — Michael A. Mann; NexsenPruet, LLC

(57) ABSTRACT

A screen door made of foamed polymer with heat welded joins between rails and stiles and a flat spline groove. The rails and stiles are extruded with the flat spline groove. Prior to joining the rails and stiles, a thin notch is made to remove the smooth skin of the extruded stiles before being joined to the cut ends of the rails. The heat welded joint between the notched stile and cut end of the rail is ten times stronger than conventional polymer door joints. A flat spline is used to insert the marginal portion of the screen into the flat spline groove, which is wider in the interior than at its entrance and resists the pull from normal forces on the screen much more effectively than a round spline in a rectangular groove.

20 Claims, 4 Drawing Sheets

(56) References Cited

U.S. PATENT DOCUMENTS 8,984,821 B2 * 3/2015 Bruno ..... E06B 3/72 52/210
2005/0230068 A1 * 10/2005 Green ..... E05D 15/0691 160/371
2007/0169884 A1 * 7/2007 Henderson ..... B29C 47/0028 156/309.6
2009/0115097 A1 * 5/2009 de Groot ..... B29C 53/063 264/250
2009/0165405 A1 7/2009 Fagan et al.
2010/0175827 A1 * 7/2010 Eisenbach ..... B29C 65/2023 156/322
2011/0314762 A1 12/2011 Widmer et al.
2014/0072752 A1 * 3/2014 Moulin ..... B29C 53/063 428/58

* cited by examiner

SCREEN DOOR

BACKGROUND OF THE INVENTION

Screen doors are available in a variety of materials, including metal, typically aluminum, and which tends to corrode, and wood, often from rain forest trees and which requires painting from time to time. Newer screen doors are made of foamed polymer and do not need to be painted but have their own drawbacks.

Screen doors made of foamed polymer are otherwise similar in appearance to conventional screen doors. They have two stiles (vertical members) and at least two and often three rails (horizontal members) formed into a simple frame. To join the stiles and rails at corners, either wooden dowels or screws with wooden pegs, or a combination, are used to form the joint. Holes are drilled in the ends of the rails and in the sides of the stiles near their ends. Dowels are inserted in the holes. The ends of a stile and a rail are pushed together with the dowels running from one to the other to form a joint. Alternatively, they are fastened together using deep-set screws and then the holes above the screws are filled with plastic pegs to form the joint.

In time, the wood of the dowels can start to rot. Screen doors are invariably exposed to the elements so moisture will inevitably enter the joint. Eventually the joints will fail.

The screens of polymer screen doors are installed by forcing them into grooves routed into one side of the stiles and rails of the screen door frame. The screen is held in place in its groove by a rubber spline. The rubber spline, being resilient, is compressed when pressed into the groove and thus holds the screen in place by friction. However, the spline and the screen can be pulled out if sufficient force is applied in a direction normal to the screen. Typically, the repeated pressure of someone's hand on the screen to open the screen door will gradually cause the screen to deform, or bag, until eventually it loosens.

Thus, there is a need for a better foamed polymer screen door, one in which the door's joints and screen securement are as durable as the foamed polymer of the frame.

SUMMARY OF THE INVENTION

The present invention is a screen door in which the joints are not only more durable than those made with dowels but are much stronger, and the manner in which the screen is held to the frame is much more secure.

The joint may made by first removing the thin "skin" on the surface of foamed polymer near the ends of a stile to expose its foamed interior. Then that exposed portion is heat-welded to the cut end of a rail. This joint is more than ten times stronger than a joint made with dowels and will not fail before the door fails.

To make a better securement for the screen, the cylindrical spline is replaced with a flat spline and the rectangular groove, with a spline groove, shaped to make use of the flat spline shape. The flat spline groove is not formed by routing the polymer, but is extruded in the process of forming the stiles and rails. The shape of a spline groove is wider in the interior than at its entrance and resists the pull from normal forces on the screen much more effectively than a round spline in a rectangular groove.

These and other features and advantages will be apparent to those skilled in the art of screen doors from a careful reading of the Detailed Description of Embodiments accompanied by the drawings.

DETAILED DESCRIPTION OF EMBODIMENTS OF THE INVENTION

Figure 1:
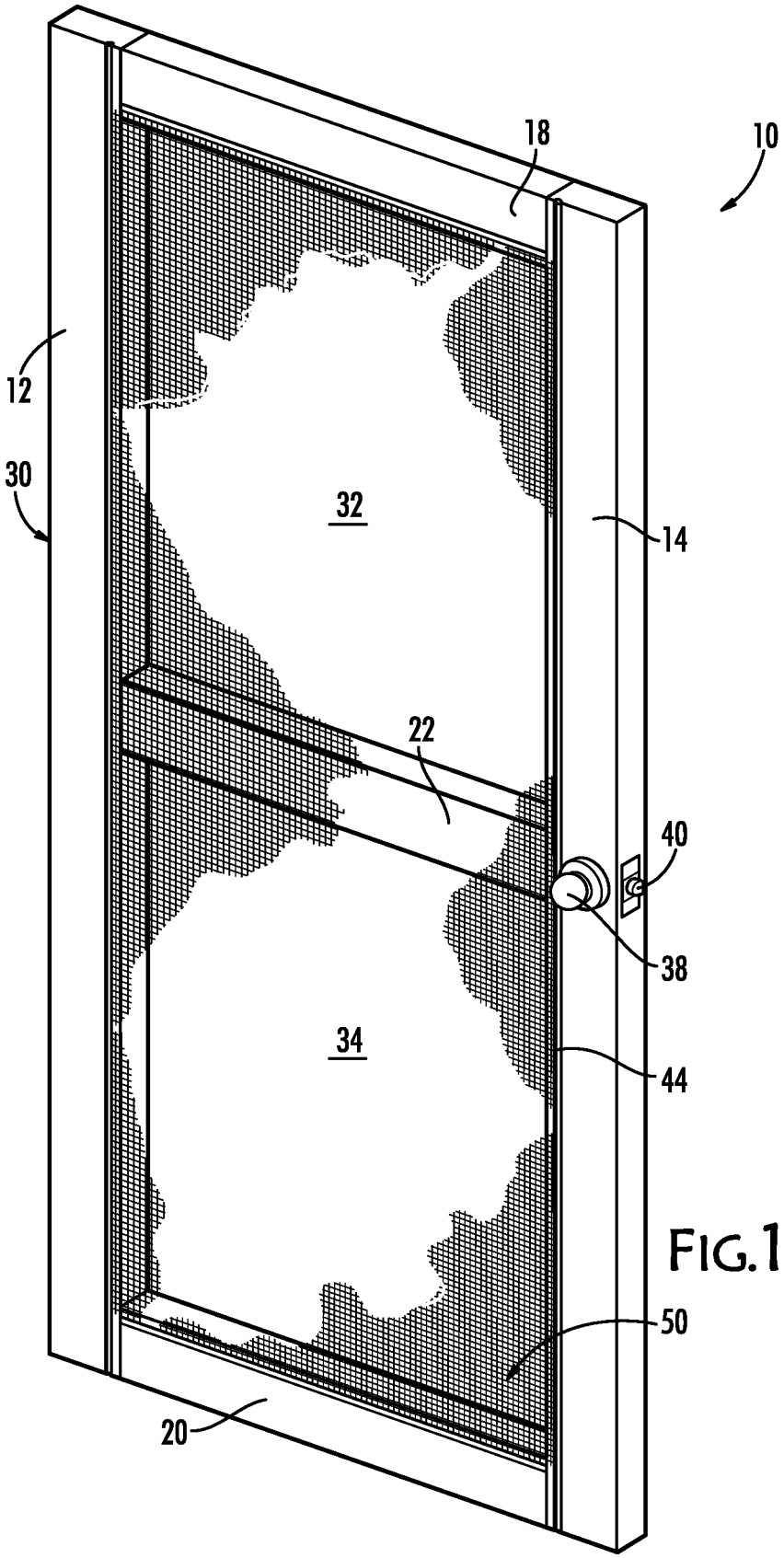
FIG. 1 is a perspective view of a screen door according to an embodiment of the invention.

Referring now to the figures, FIG. 1 shows in perspective the present foamed polymer screen door 10. Screen door 10 includes a left and a right stile 12, 14. In this example, an upper rail 18, lower rail 20, and middle rail 22 are used to form screen door 10. Additional rails may be used or middle rail 22 may be eliminated altogether.

Left and right stiles 12, 14, are connected to upper, lower, and middle rails 18, 20, 22, to form a rectangular frame 30. Frame 30 with middle rail 22 has an upper opening 32 and a lower opening 34. Without middle rail 22, there would be just one opening.

The terms left and right, upper and lower refer to the screen door when installed and with its major dimension oriented vertically with respect to the floor. In that orientation and with a handle 38 on the right, left stile 12 is on the left-hand side of screen door 10 and right stile is on the right-hand side of screen door 10. Upper rail 18 is at the top of screen door 10 and lower rail 20 is at the bottom of screen door 10. Middle rail 22 is somewhere between upper and lower rails 18, 20.

Different structural components, such as pickets, may be used for the interior of frame 30 in addition to middle rail 22 or in lieu of it. These different components may serve utilitarian purposes or decorative or both without departing from the present invention.

Screen door 10 will also be equipped with hinges (not shown), and perhaps with return springs or air cylinders to facilitate controlled closing of screen door 10.

Screen door 10 has a spline groove 44 formed in left and right stiles 12, 14 and in upper and lower rails 18, 20. Spline groove 44 runs generally parallel to the major dimensions of both left and right stiles 12, 14 and upper and lower rails 18, 20, and there may be no spline grooves 44 or two spline grooves 44 in middle rail 22, depending on whether a single screen is desired over both openings 32, 34 or over each opening 32, 34. Spline groove 44 is an important feature of the present invention, and will be described more fully below.

A screen mesh 50 is used to cover openings 32, 34. Screen mesh 50 may be any conventional screen mesh, which is typically a woven grid of wires with a mesh spacing dimensioned to be small enough to prevent flies and other small flying insects from passing through screen mesh 50 but to allow air and light to pass and to have only a limited effect on visibility though openings 32,34. Wires for screen mesh 50 are commonly made of polyester, fiberglass, aluminum, brass but other materials may be used.

Figure 2:
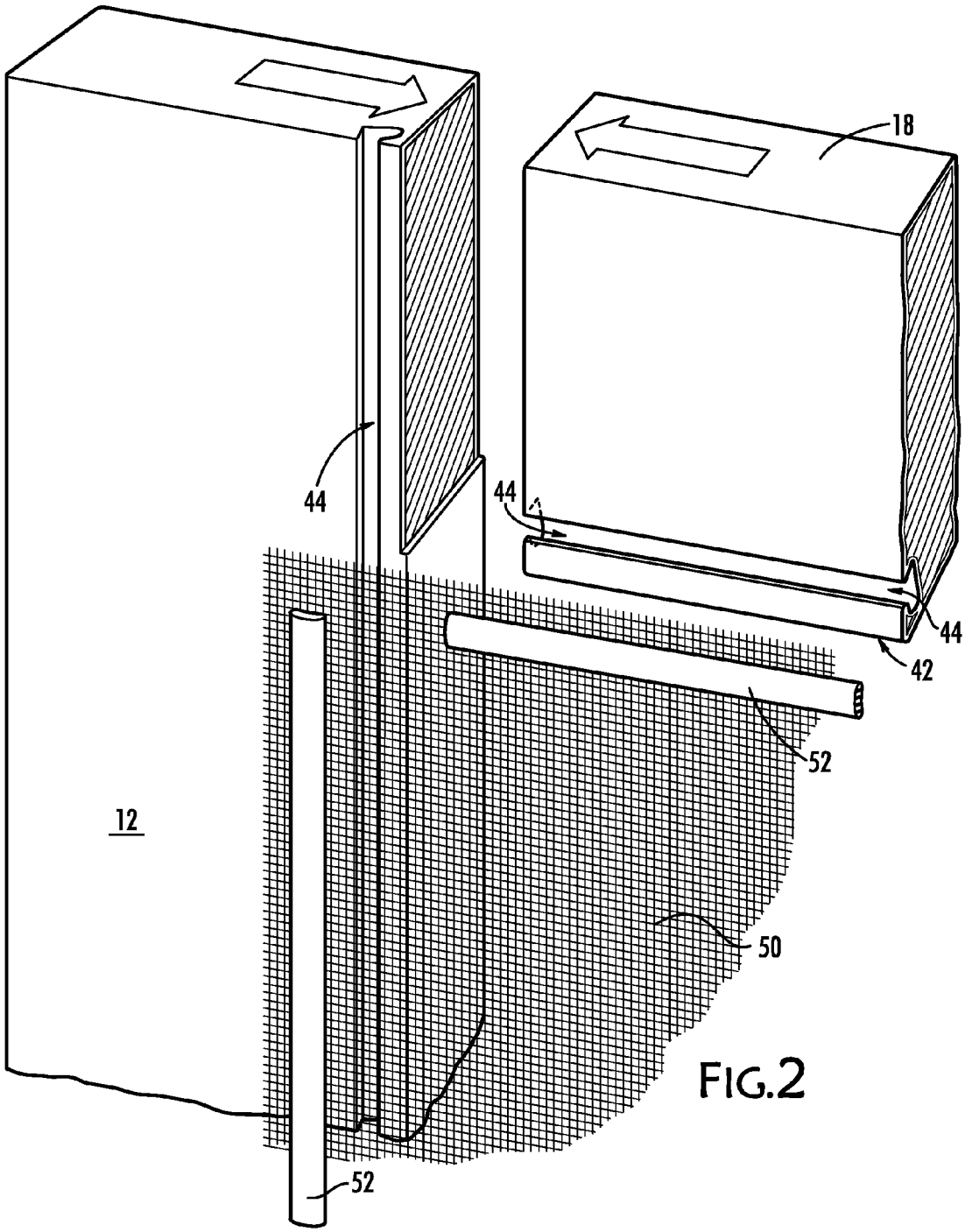
FIG. 2 is an exploded view of the top left corner of a screen door, according to an embodiment of the invention.

FIG. 2 illustrates in an exploded, perspective view how stiles 12, 14, are joined to rails 18, 20. FIG. 2 shows in perspective a detail of the top, left corner of screen door 10 shown in FIG. 1. Upper rail 18 is shown being joined to stile 12 by the arrow. When polymer is foamed and extruded, the interior of the foamed polymer comprises a multiplicity of small cells but its exterior has a smooth skin, essentially free of holes. To join rail 18 to stile 12, the skin of stile 12 on its right side near its upper end may be removed. The amount of material removed to expose the rough, cellular foamed polymer interior is slight, as the skin is not deep. Accordingly, only a thin layer need be removed, which may be done by sanding or grinding. The removed material leaves a shallow notch 42 in stile 12. The exposed cellular surface at notch 42, being rough and porous, facilitates a joint secured by either adhesives or heat welding. It is sufficient for notch 42 to be no more than a few millimeters, for example, less than 5 millimeters, and ideally even less than about 2 mm from the surface to expose the rough textured cells on the interior of the extruded polymer.

Since the ends of the extruded stiles 12, 14 are cut to the appropriate length, their interiors are already exposed at those ends. Accordingly, the joint will place both rail interiors at their cut ends and stile interiors at their notched sides near their ends against each other, such as when notch 42 of stile 12 is placed against the end of rail 18. As taught by FIG. 2, notch 42 formed in the right side of the upper end of stile 12 will be joined to the exposed interior of the cut end of rail 18. By extension to the other joints of frame 30, a notch in the right side of the lower end of stile 12 will be joined to the cut lower left end of lower rail 20; the cut lower right end of lower rail 20 will be joined to the notch formed in the left side of the lower end of stile 14; and the right end of upper rail 18 will be joined to the notched side of the upper end of stile 14. Similarly, for middle rail 22, the interiors of its ends will already be exposed when cut to length, and it will be welded to the surface of the sides of left and right stiles 12, 14, either with or without notches being formed in the sides of stiles 12, 14.

Attaching stiles and rails by heat welding is well-suited for a manufacturing process and results in a very strong bond. Testing of a heat-welded joint according to the present invention shows it to be over three times stronger than the joint made with dowels, and allows consideration of using less material in the stiles and rails while still providing sufficient strength. Thus, not only is the issue of wood rot eliminated and the new joint highly resistant to water damage but, the joint has surprising strength in comparison to the prior art joints.

Figure 4:
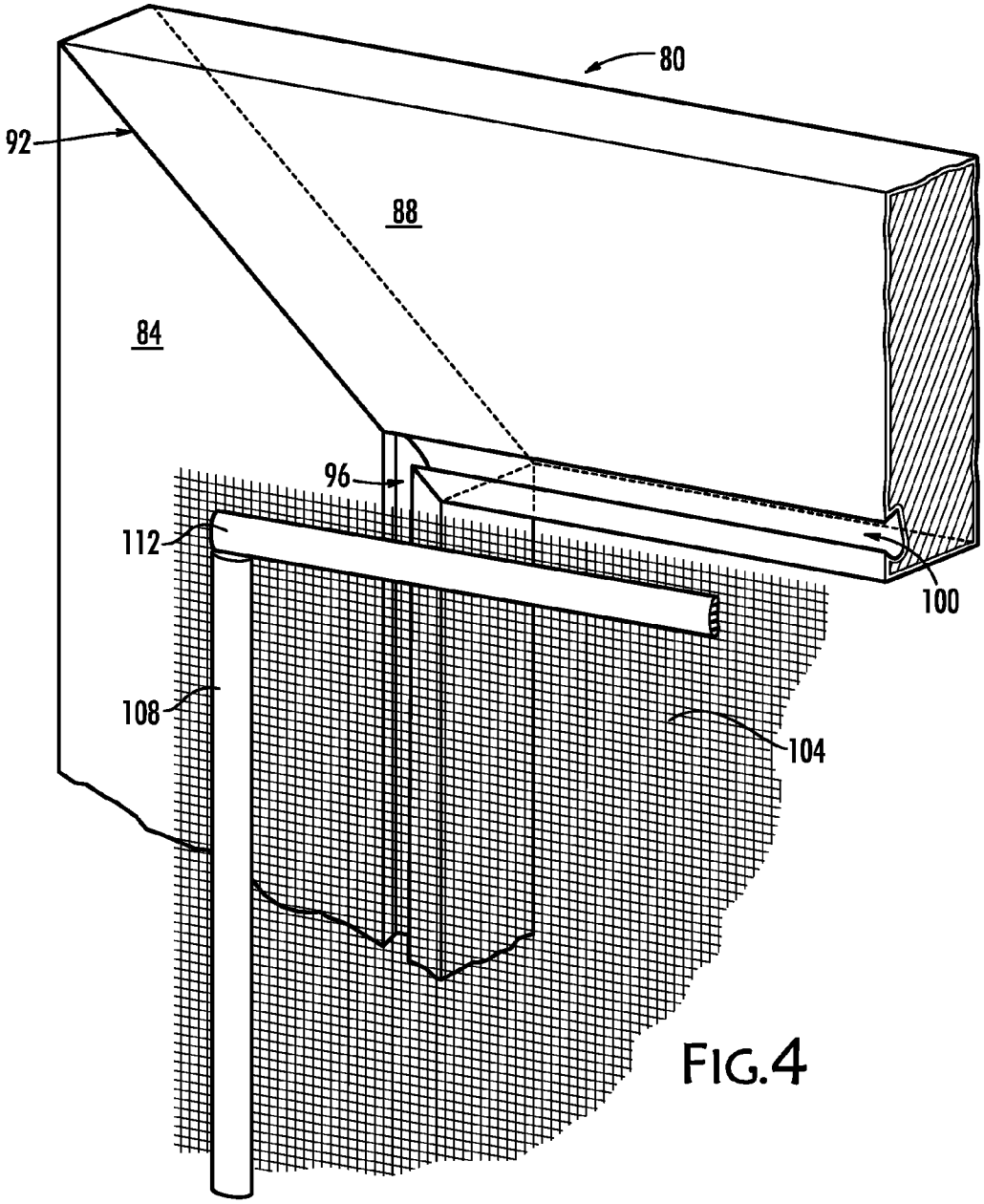
FIG. 4 is a detailed, perspective, partially cutaway view of corner of a screen door with a 45 degree welded joint, according to an alternative embodiment of the present invention.

It is also possible to join rails 12 and stiles 14 using a 45 degree cut as shown in FIG. 4, which shows the upper end of stile 12 joined to the left end of rail 18, but the customary joint for a door, one that is preferred cosmetically by consumers, is a 90 degree joint.

Figure 3A:
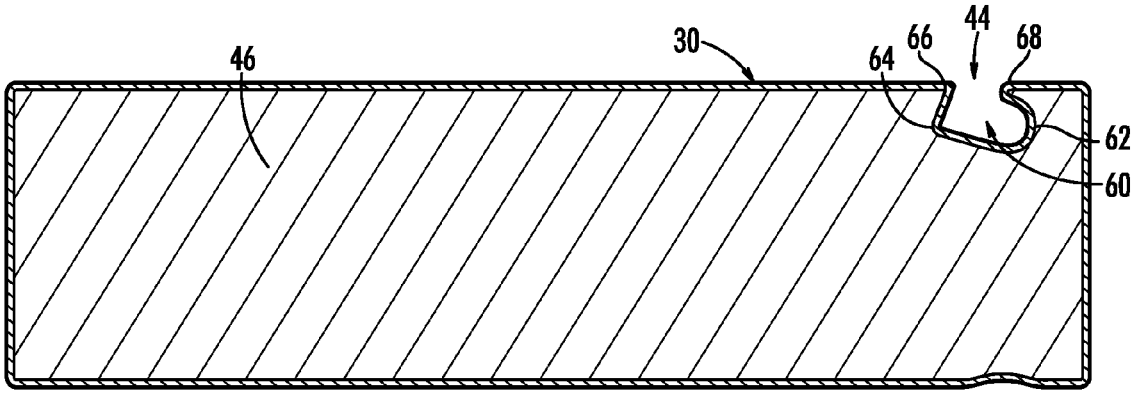
FIG. 3A is a cross-section of a portion of the frame of a screen door, which portion could come from either a rail or a stile, according to an embodiment of the invention.
Figure 3B:
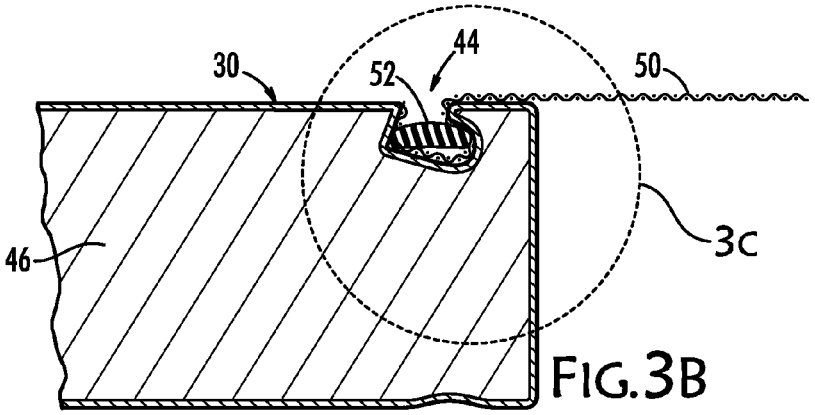
FIG. 3B is a detail of the element of FIG. 3A with screen installed, according to an embodiment of the invention.
Figure 3C:
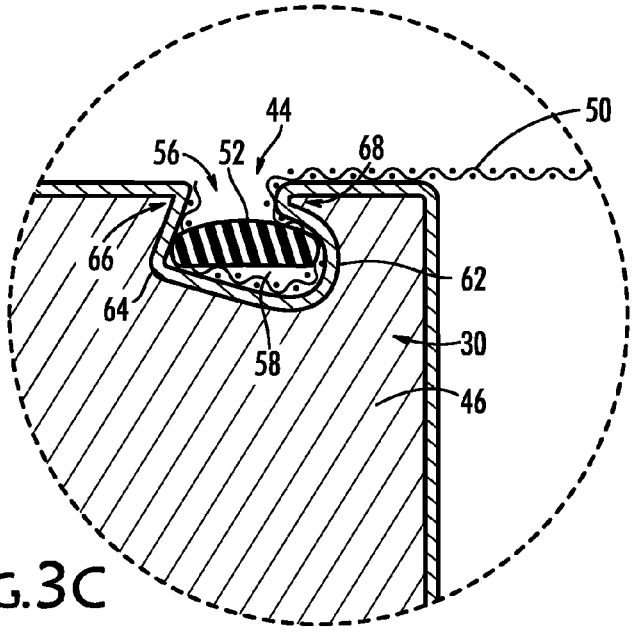
FIG. 3C is an enlarged view of the detail 3C of FIG. 3B.

FIGS. 3A-3C illustrate the cooperation of flat spline 52 in a flat spline groove 44. FIG. 3A shows a portion of a frame 30 in cross section. Flat spline groove 44 is seen in cross section to have an entrance 56 and an interior 60. Unlike prior art spline grooves which are rectangular, and of uniform width, the width of entrance 56 of spline groove 44 is narrower than the width of interior 58 spline groove 44. Furthermore, spline groove 44 has a shape similar to a bootie, with a toe 62 and a heel 64. The bootie-like shape of spline groove 44 leaves a first lip 66 above toe 62 and a second lip 68 above heel 64.

As best seen in FIG. 2, screen mesh is held in place over openings, such as openings 32, 34, shown in FIG. 1, by pushing its marginal edge into spline groove 44 using a spline 52. Screen mesh 50 is held in place in spline groove 44 wrapped around spline 52. In the present invention, a flat spline 52 and a particular type of groove, namely, a flat spline groove 44 are used. A flat spline 52 has a major dimension that will be oriented parallel to the long dimension of a spline groove 44, and two minor dimensions. One of the two minor dimensions is larger than the other so that, from the end, a flat spline has a roughly rectangular cross-section.

FIG. 2 also shows screen mesh 50 between flat spline 52 and spline groove 44 in rail 12 and stile 18. To install screen mesh 50 in flat spline groove 44, screen 50 is placed between flat spline groove 44 and flat spline 52, and then flat spline 52 is pressed against screen 50 to drive it into spline groove 44 with a rotating motion so that one side of flat spline 52 passes through the narrow entrance 56 of flat spline groove 44 first followed by the opposing side of spline 52.

As best seen in FIGS. 3A-3C, spline groove 44 has toe 62 oriented slightly more toward the interior of a frame member 46 than its heel 64. Toe 62 is oriented in the direction screen mesh 50 will respond when a normal force is applied to it. With this orientation and with screen mesh 50 wrapped around flat spline 52, first lip 66 of spline groove 44 will assist in holding spline 52 in groove 44. Also, a second lip 68 holds heel 64 in flat spline groove 44, too, so screen mesh 50 will only be removed when flat spline 52 is compressed against its own larger minor dimension, namely, its width. The undercut spline groove interior 58 allows the flexible flat spline 52 to be inserted through entrance 56 into the larger interior 58 below. Once through entrance 56, flat spline 52 relaxes back into its original shape with screen mesh 50 running along the contours of interior 58 and with the material of spline 52 pushing against the opposing walls of interior 58. As a normal force is applied to screen mesh 50, flat spline 52 is urged upward toward the narrow entrance 56. As it begins to move upward (only on one side of flat spline 52, the side where the screen force is applied), it tightens against screen mesh 50 as it moves away from the wider interior 58 and toward narrower entrance 56. Thus, the shape of spline groove 44 with first and second lips 66, 68 at entrance 56, provides a "locking" feature.

FIG. 4 shows an alternative embodiment of the present screen door 80. The top left corner of screen door 80 is shown, the bottom left, top right and bottom right corners being mirror images of the top left corner. Screen door 80 has a stile 84 and a rail 88 that are cut at an angle of approximately 45 degrees with respect to their major dimensions so as to be joinable to form a 90 degree angle. The cut ends of stile 84 and rail 88 are then heat welded to secure them together at the joint 92.

Stile 84 and rail 88 are made with spline grooves 96, 100, respectively, for receipt of screen 104 and splines 108, 112, as described above.

The combination of the heat-welded joint of rails 12, 14 and stiles 18, 20, 22, and use of a flat spline 52 in a flat spline groove 44 results in a screen door 10 that is surprisingly strong. In a test of the strength of the flat spline 52 in groove 44, approximately 1000 pounds was applied normal to the surface of the screen without pulling it free. Tests of the present stile-rail joints show it is four times stronger than a dowel joint.

The additional strength of screen door 10 can result in a material savings by making rails 12, 14, and stiles 18, 20, 22, thinner. The extrusion of rails 12, 14, stiles 18, 20, 22, with flat spline grooves 44 formed in them also avoids the milling step previously used to form the prior art groove. Also the labor and materials of joining rails and stiles with dowels, screws, plugs and glue is completely avoided.

Those skilled in the art of screen door manufacturing will appreciate that many modifications and substitutions may be made to the foregoing preferred embodiments without departing from the spirit and scope of the appended claims.

What is claimed is:

1. A process for making a screen door comprising the steps of:

(a) extruding two stiles of foamed vinyl, each stile of said two stiles having a spline groove, said spline groove having an entrance and an interior, said two stiles having a skin exterior and a porous interior, and wherein said entrance to said spline groove is narrower than said interior of said groove, wherein said each stile has a top end and an opposing bottom end;

(b) cutting said top end and said bottom end of said each stile of said two stiles to expose said porous interior;

(c) extruding two rails of foamed vinyl, each rail of said two rails having a spline groove, each rail of said two rails having a skin exterior and a porous interior, said spline groove in said each rail having an entrance and an interior, and wherein said entrance to said spline groove is narrower than said interior of said groove, wherein said each rail of said two rails has a left end and a right end;

(d) cutting said left end and said right end of said each rail to expose said porous interior;

(e) securing said porous interior of said left end and said right end of a first rail of said two rails to said porous interior of said top ends, respectively, of said two stiles, and said porous interior of said left end and said right end of a second rail of said two rails to said porous interior of said bottom ends, respectively, of said two stiles to form joints for a rectangular frame resistant to moisture and having an opening within said frame bordered by said two rails and said two stiles;

(f) covering said opening of said two stiles and two rails with screen mesh; and (g) inserting a spline over said mesh and into said spline grooves of said two stiles and two rails to hold said screen mesh in said spline grooves of said two stiles and said two rails, said spline having a major dimension and two minor dimensions, wherein one minor dimension of said two minor dimensions is larger than said other minor dimension of said two minor dimensions.

2. The process as recited in claim 1, wherein said step of cutting said top end and said bottom end of said each stile further comprises grinding notches in said exterior of said skin exterior of said top end and said bottom end of said each stile to a depth not more than 5 cm.

3. The process as recited in claim 2, wherein said step of securing said porous interior of said left end and said right end of a first rail of said two rails to said porous interior of said top ends, respectively, of said two stiles, and said porous interior of said left end and said right end of a second rail of said two rails to said porous interior of said bottom ends, respectively, of said two stiles to form joints for a rectangular frame further comprises the step of heat welding said left end and said right end of said two rails to said top ends and said bottom ends of said two stiles.

4. The process as recited in claim 1, wherein said step of cutting said left and said right ends of said first and said second rails of said two rails by grinding notches in said left end and said right end of said first and said second rails to receive said top end and said bottom end of said first and second stiles of said two stiles.

5. The process as recited in claim 4, wherein said step of securing said porous interior of said top end and said bottom end of a first stile of said two stiles to said porous interior of said left ends of said two rails, and said porous interior of said top end and said bottom end of a second stile of said two stiles to said porous interior of said bottom ends, respectively, of said two stiles to said porous interior of said right ends of said two rails to form joints for a rectangular frame further comprises the step of heat welding said left end and said right end of said two rails to said top ends and said bottom ends of said two stiles.

6. A process for making a screen door, comprising the steps of:

(a) extruding two stiles of foamed vinyl, each stile of said two stiles having a top end and an opposing bottom end, said each stile of said two stiles having a spline groove formed therein, said spline groove in said each stile having an entrance and an interior, said two stiles having a skin exterior and a porous interior;

(b) cutting said top end and said bottom end of said each stile of said two stiles to expose said porous interior;

(c) extruding two rails of foamed vinyl, each rail of said two rails having a left end and an opposing right end, said each rail of said two rails having a spline groove formed therein, said spline groove in said each rail having an entrance and an interior, said each rail of said two rails having a skin exterior and a porous interior;

(d) cutting a notch in said skin exterior of said left end and a notch in said skin exterior of said right end of said each rail of said two rails to expose said porous interior;

(e) securing said porous interior of notches in said left end and said right end of a first rail of said two rails to said porous interior of said top end of said each stile of said two stiles;

(f) securing said porous interior of said notches in said left end and said right end of a second rail of said two rails to said porous interior of said bottom end of said each stile of said two stiles, wherein said two stiles and said two rails form a rectangular frame resistant to moisture and having an opening within said frame bordered by said two rails and said two stiles;

(g) covering said opening of said two stiles and two rails with screen mesh; and (h) inserting a spline over said mesh and into said spline grooves of said two stiles and two rails to hold said screen mesh in said spline grooves of said two stiles and said two rails.

7. The process as recited in claim 6 for making a screen door, wherein said spline has a major dimension and two minor dimensions, wherein a first minor dimension of said two minor dimensions is larger than said second minor dimension of said two minor dimensions.

8. The method as recited in claim 6, wherein said spline groove in said each rail and said spline groove in said each stile are formed by extrusion.

9. The method as recited in claim 6, further comprising the step of milling said spline groove in said each rail of said two rails and in each stile of said two stiles after extruding said each rail of said two rails and said each stile of said two stiles.

10. The method as recited in claim 6, wherein the step of securing said notches in said left end and said right ends of said first rail to said top ends of said left and said right stiles is by heat welding, and the step of securing said notches in said left end and said right ends of said second rail to said bottom ends of said left and said right stiles is by heat welding.

11. The method as recited in claim 6, wherein said notch is not deeper than 5 mm.

12. The method as recited in claim 6, wherein said spline groove has an entrance and an interior and wherein said entrance is narrower than said interior.

13. A process for making a screen door, comprising the steps of:

(a) extruding two stiles of foamed vinyl, each stile of said two stiles having a top end and an opposing bottom end, said each stile of said two stiles having a spline groove formed therein, said spline groove in said each stile having an entrance and an interior, said two stiles having a skin exterior and a porous interior;

(b) cutting a notch in said skin exterior of said top end and a notch in said bottom end of said each stile of said two stiles to expose said porous interior;

(c) extruding two rails of foamed vinyl, each rail of said two rails having a left end and an opposing right end, said each rail of said two rails having a spline groove formed therein, said spline groove in said each rail having an entrance and an interior, said each rail of said two rails having a skin exterior and a porous interior;

(d) cutting said left end and said right end of said each rail of said two rails to expose said porous interior;

(e) securing said porous interior of said left end and said right end of a first rail of said two rails to said notches cut in said top end of said each stile of said two stiles;

(f) securing said porous interior of said left end and said right end of a second rail of said two rails to said notches cut in said bottom end of said each stile of said two stiles, wherein said two stiles and said two rails form a rectangular frame resistant to moisture and having an opening within said frame bordered by said two rails and said two stiles;

(g) covering said opening of said two stiles and two rails with screen mesh; and (h) inserting a spline over said mesh and into said spline grooves of said two stiles and two rails to hold said screen mesh in said spline grooves of said two stiles and said two rails.

14. The process as recited in claim 13 for making a screen door, wherein said spline has a major dimension and two minor dimensions, wherein a first minor dimension of said two minor dimensions is larger than said second minor dimension of said two minor dimensions.

15. The method as recited in claim 13, wherein said spline groove in said each rail and said spline groove in said each stile are formed by extrusion.

16. The method as recited in claim 13, further comprising the step of milling said spline groove in said each rail of said two rails and in each stile of said two stiles after extruding said each rail of said two rails and said each stile of said two stiles.

17. The method as recited in claim 13, wherein the step of securing said left ends of said each rail of said two rails to said notches in said left stile and said right ends of said each rail of said two rails to said notches in said right stile is by heat welding.

18. The method as recited in claim 13, wherein the step of securing said left ends of said each rail of said two rails to said notches in said left stile and said right ends of said each rail of said two rails to said notches in said right stile is by using adhesives.

19. The method as recited in claim 13, wherein said notch is not deeper than 5 mm.

20. The method as recited in claim 13, wherein said spline groove has an entrance and an interior and wherein said entrance is narrower than said interior.

* * * * *